US006260774B1

(12) United States Patent
Erickson

(10) Patent No.: US 6,260,774 B1
(45) Date of Patent: Jul. 17, 2001

(54) WATER SPRAY GUN WITH INCREMENTALLY CONTROLLABLE LOCKING TRIGGER

(76) Inventor: K. C. Erickson, 512 E. 325 North, Centerville, UT (US) 84014

( * ) Notice: Subject to any disclaimer, the term of this patent is extended or adjusted under 35 U.S.C. 154(b) by 0 days.

(21) Appl. No.: 09/526,931

(22) Filed: Mar. 16, 2000

(51) Int. Cl.[7] ..... B05B 9/01
(52) U.S. Cl. ..... 239/526
(58) Field of Search ..... 239/525, 526

(56) References Cited

U.S. PATENT DOCUMENTS

| | | | | |
|---|---|---|---|---|
| 3,888,421 | * | 6/1975 | Chow | 239/526 X |
| 4,389,017 | * | 6/1983 | Geberth, Jr. | 239/526 X |
| 5,143,299 | * | 9/1992 | Simonetti et al. | 239/526 |
| 5,303,868 | * | 4/1994 | Kroll | 239/526 X |
| 5,323,968 | * | 6/1994 | Kingston et al. | 239/526 X |
| 5,662,273 | * | 9/1997 | Chih | 239/526 |
| 5,806,770 | * | 9/1998 | Wang | 239/526 X |
| 5,881,955 | * | 3/1999 | Styne | 239/526 X |
| B1 6,173,911 | * | 1/2001 | Hui-Chen | 239/526 |

* cited by examiner

*Primary Examiner*—Lesley D. Morris

(74) *Attorney, Agent, or Firm*—Mallinckrodt & Mallinckrodt; Brian R. Rayve

(57) ABSTRACT

A water spray device for connection to a standard garden hose, having an adjustable incrementally lockable trigger mechanism for controlling the flow of water from a standard spray nozzle or extension spray wand attached thereto. The spray device includes a housing which can be in the form of a pistol grip that is connectable at a lower end to the garden hose and at an upper end to the nozzle or wand. A water passageway extends through the housing with a trigger chamber formed at the front of the housing with an actuator pin receiving hole connecting therebetween. A trigger having an upper notch is pivotally disposed within the chamber with a spring loaded trigger lock which fits within the notch linearly slidably mounted to the housing. The lower edge of the notch is sharpened and interacts with a lower ribbed surface of the trigger lock which is upwardly rearwardly angled relative to the linear motion of the trigger lock so as to engage the lower edge of the trigger when depressed to depress the trigger and release when the trigger alone is depressed. A spring loaded actuator pin is slidably disposed in the actuator pin hole which outwardly biases the trigger for actuation thereby to open a closed-biased valve disposed within the water passageway. When force applied to depress the trigger lock and released, the trigger and the trigger lock are wedged together so as to be retained in that position until force is applied to depress the trigger to move the lower portion of the notch out of contact with the lower portion of the trigger lock and released to stop the flow of water.

40 Claims, 4 Drawing Sheets

WATER SPRAY GUN WITH INCREMENTALLY CONTROLLABLE LOCKING TRIGGER

BACKGROUND OF THE INVENTION

1. Field

The invention relates to fluid spray devices and trigger mechanisms therefore, and more specifically to water spray guns and water spray wands such as used for gardening with trigger mechanisms which lock to maintain the flow of water.

2. State of the Art

Water spray devices such as pistol grip water spray guns and water spray wands are used by gardeners such as to water gardens and lawns. Such devices typically connect to the male threaded connector end of a standard garden hose and include a trigger mechanism to actuate a valve which controls the flow of water therefrom. Various removable nozzles can typically be attached to the same basic spray device to provide the desired water spray pattern to fit the particular spray application. Some of such water spray devices have trigger mechanisms and valves which permit the flow of water to be infinitely varied from no flow to full flow. Others are merely allow no flow and full flow with no variability therebetween.

There are a number of water spray guns which are of the pistol grip type, several being disclosed in U.S. Pat. Nos. 5,967,421, 5,967,422, and 6,007,003 all of which are issued to Wang. The basic water spray gun disclosed in those patents which includes a housing having a lower grip portion and an upper spray portion angled to the grip portion, and a trigger receiving chamber at the front of the grip portion. A water passageway extends completely through the housing, the end of the grip portion having a female threaded portion adapted to be threadably secured to the male threaded connector of a standard garden hose and the end of the spray portion adapted for connecting a water spray nozzle. A trigger receiving chamber is formed at the front portion of the grip portion of the housing. The water spray gun further includes a linearly actuated valve which includes a resilient valve seat which fits within the water passageway at an annular shoulder thereof, a slidable valve member with a pointed nose portion and annularly tapered seat which matingly fits with the valve seat, a compression spring to bias the valve member toward the valve seat, and a screen spring retainer to retain the spring within the water passageway. A trigger mechanism of the water spray gun includes a hollowed trigger having an upper notch and lower actuation post extending rearwardly from a front wall thereof, which trigger is pivotally mounted partially within the chamber at respective upper ends of respective sidewalls thereof, a headed slide pin having respective headed and pointed ends and a pair of annular O-rings and grooves, which slide pin slidably fits within a tubular post of the housing which fluidly connects with the water passageway with a compression spring therebetween to bias the slide pin forwardly against the actuation post of the trigger, and a hollowed trigger lock having a tubular post which extends rearwardly from a front wall thereof over a stepped post of the housing with a compression spring therebetween to bias the trigger lock forwardly. When the trigger is depressed toward the housing, the post thereof pushes the pointed end of the slide pin into contact with the pointed end of the slide valve so as to move the seat thereof away from the valve seat so as to allow water flow through the water passageway. The trigger lock includes a downwardly and rearwardly sloped lower face which abuts a lower edge of the notch of the trigger such that as the trigger is depressed and pivots, the trigger lock is also depressed so as to lock the trigger in the full on water spray position. The trigger lock is released by further depressing the trigger lock which allows the trigger to return to the undepressed position so as to stop the flow of water.

One version of the trigger lock is disclosed in the '421 patent which includes a non-textured, smooth sloped lower face, or micro-adjustment slope face. In practice, such slope face provides only for full water flow rather than any adjustability of the water flow as the sloped lower face relies on friction alone for locking and does not provide adequate holding force to maintain the desired rate of water flow. Another version of the trigger lock is disclosed in the '422 patent which includes a smooth sloped lower face having a pair of longitudinal slits therein so as to form a resilient pushing section, or tab, having a guide edge at the free end thereof. This second version is evidently an attempt to overcome such shortfalls of the first version trigger lock yet still does not provide adequate frictional force to maintain the desired water flow rate. Yet another version of the trigger lock is disclosed in the '003 patent which includes a zig-zag or stepped sloped lower face wherein the stepped configuration thereof is to allow the trigger lock to move in a more precise, stepwise manner to micro-adjust the water amount in a stepwise manner rather than merely relying on friction between the sloped face and the edge of the trigger hold the position thereof.

There is a need for a fluid spray device such as for spraying water and a trigger locking mechanism which allows true incremental locking and flow control of the fluid.

SUMMARY OF THE INVENTION

The invention is a fluid spray device (hereinafter called a water spray device) such as for spraying water having an adjustable locking trigger mechanism for controlling the flow of fluid (hereinafter called water) from the water spray device, the water spray device being for use with a flexible conduit having end connectors (hereinafter called a garden hose), such as a standard garden hose of the type having a flexible body with respective male and female threaded connectors affixed to opposite ends thereof, and with a removable or permanently attached water outlet device (hereinafter called a spray nozzle) connectable thereto. The invention further comprises such a trigger mechanism for use with water spray devices.

The water spray device comprises a housing, a closed-biased valve assembly, and a trigger mechanism, for connection to a spray nozzle such as a standard single outlet nozzle, rotary multiple outlet nozzle, and an extension wand such as U-shaped for washing out gutters or angled for watering hanging plants.

The housing comprises a lower gripping portion, a middle trigger portion having a trigger chamber, and an upper nozzle attachment portion. The gripping portion is connectable to the standard garden hose, such as by means of having a female threaded end connectable to the male connector of the garden hose and the upper nozzle attachment portion is connectable to the desired water outlet device at a nozzle attachment end thereof. A water passageway typically of circular cross-section extends completely through the housing from the female threaded end to the nozzle attachment end with a downwardly angled actuator member receiving hole which connects the trigger chamber to the water passageway.

The trigger mechanism comprises a trigger, a trigger lock, a pair of first and second springs, and an actuator member.

The trigger is movably connected to the housing partially disposed within the trigger chamber and includes a notch through an upper portion of the trigger. The trigger lock is movably connected to the housing within the notch of the trigger partially disposed within the trigger chamber and is outwardly biased by the first spring. One of the trigger and the trigger lock is pivotally movably connected to the housing, typically the trigger, and the other is linearly movably connected to the housing, typically the trigger lock. The trigger and trigger lock are retained within the chamber such as by means of one or both thereof contacting the housing, typically the trigger with the trigger lock including a retaining means such as a pair of externally facing locking tabs having end portions which respective shoulders of mating grooves in respective inside surfaces of the notch of the trigger.

The actuator member typically of circular cross-section having a headed end for retaining the second spring thereabout and a conically pcinted opposite end for actuating the closed-biased valve assembly. The actuator member is slidably disposed in the actuator member hole and biased outwardly from the housing against the trigger by the second spring. The actuator member typically is adapted for use with a seal for fluidly sealing between the actuator member and the actuator member receiving hole of the housing to prevent fluid flow between the water passageway and the chamber of the housing. Such seal typically comprises an O-ring which is disposed in an annular groove of the circular cross-section actuator member for fluidly sealing between the inner surface of the actuator member hole and the slide pin.

The closed-biased valve assembly is disposed within the water passageway and is actuatable using the trigger assembly to open the valve assembly by means of applying force to depress the trigger toward the housing. When the trigger alone is depressed, the lower portion of the notch moves away from contact with the lower portion of the trigger lock such that the trigger lock is not depressed thereby. This causes the actuator member to contact the closed-biased valve assembly to allow free regulation of the flow of water through the water passageway and wherein releasing of the force to depress the trigger allows the closed-biased valve assembly to close shutting off the flow of water.

The trigger mechanism is lockable to maintain the desired flow rate of water by means of a lower portion of the notch of the trigger which is interactable with a lower portion of the trigger lock. When the trigger lock alone is depressed, the lower portion thereof moves toward contact with the lower portion of the notch so as to depress the trigger toward the chamber actuating the closed-biased valve assembly to allow water to flow as when the trigger is depressed as above. However, when the force applied to depress the trigger lock is released, the trigger and the trigger lock are wedged together so as to be retained in that position until force is applied to depress the trigger to move the lower portion of the notch out of contact with the lower portion of the trigger lock such that the first spring biases the trigger lock outwardly.

The lower portions of the trigger lock and the notch of the trigger typically interengage by means of one thereof, usually the trigger lock, having a laterally ribbed surface such as of a laterally convex curvature comprising a plurality of generally parallel ribs of generally triangular cross-section. The other thereof, usually the trigger, has at least one projection of mating configuration with the laterally ribbed surface, such as the lower portion of the notch of the trigger being of mating laterally concave curved configuration respective to said ribbed surface with a sharpened edge for engagement therewith. The ribbed surface is typically angled upwardly relative to tangent to the movement thereof to facilitate the required relative movement into and out of engagement with the lower portion of the notch.

The closed-biased valve assembly typically comprises a resilient valve seat, a slide valve, and a third spring. The valve seat closely fits within and is secured within the water passageway and includes a hole therethrough and a seat surface. The slide valve includes a seat surface corresponding to the seat surface of the valve seat and typically a plurality of radially extending ribs or fins to allow water to flow past the slide valve when unseated from the valve seat. The third spring is arranged with the housing so as to bias the slide valve toward the valve seat to provide a water tight seal in the water passageway. Typically, the third spring is held against the slide valve by means of a retaining screen affixed within the water passageway between the female threaded end of the housing and the valve assembly. One end of the third spring engages the slide valve and the opposite end engages the retaining screen to retain the third spring in position biased against the slide valve while allowing water flow therepast.

THE DRAWINGS

The best mode presently contemplated for carrying out the invention is illustrated in the accompanying drawings, in which.

Figure 2:
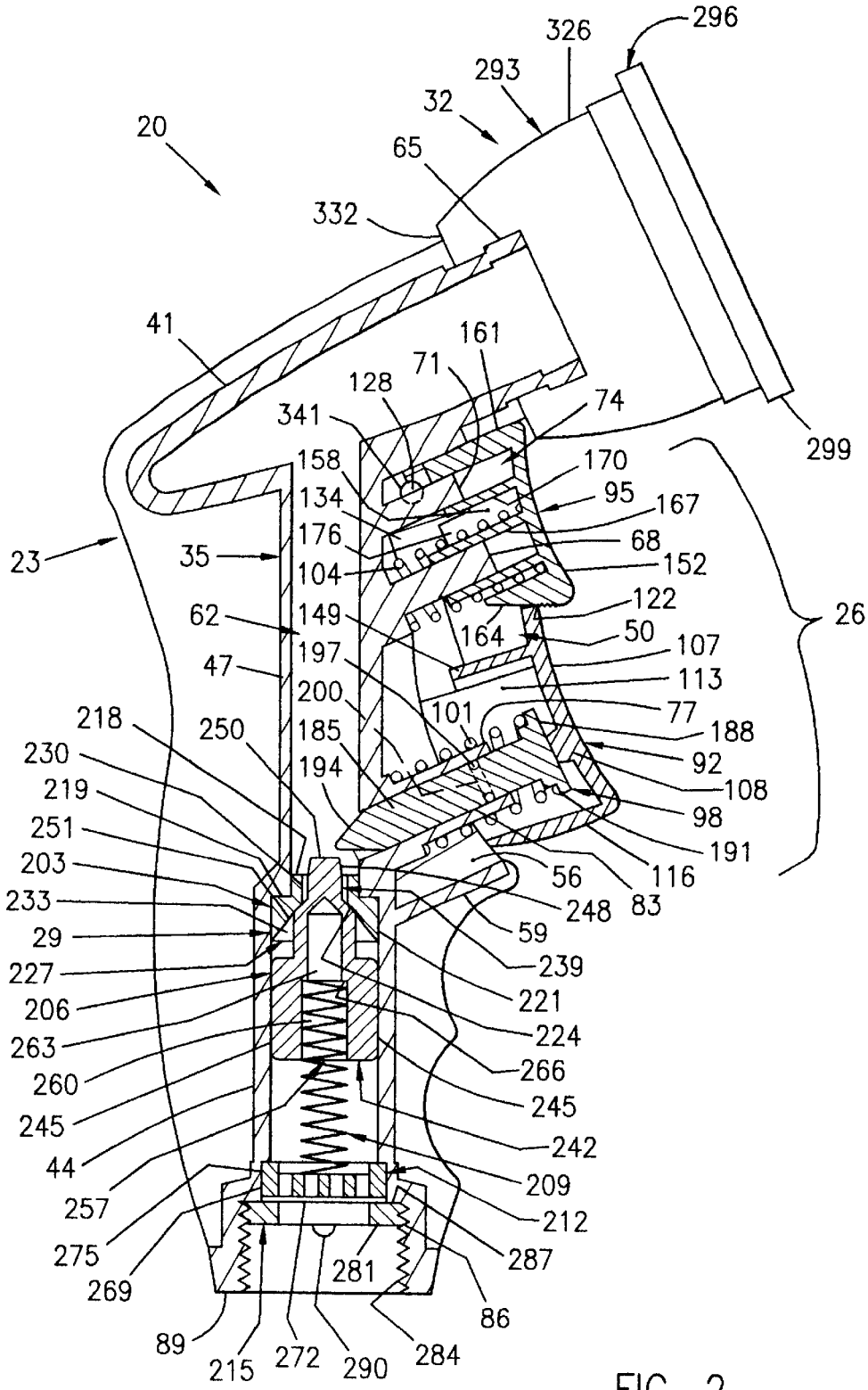
FIG. 2 is a partial vertical sectional view taken on the line 2—2 of FIG. 1 showing the internal construction of the water spray gun with the trigger and trigger lock in the unactuated positions such that no water flows.
Figure 3:
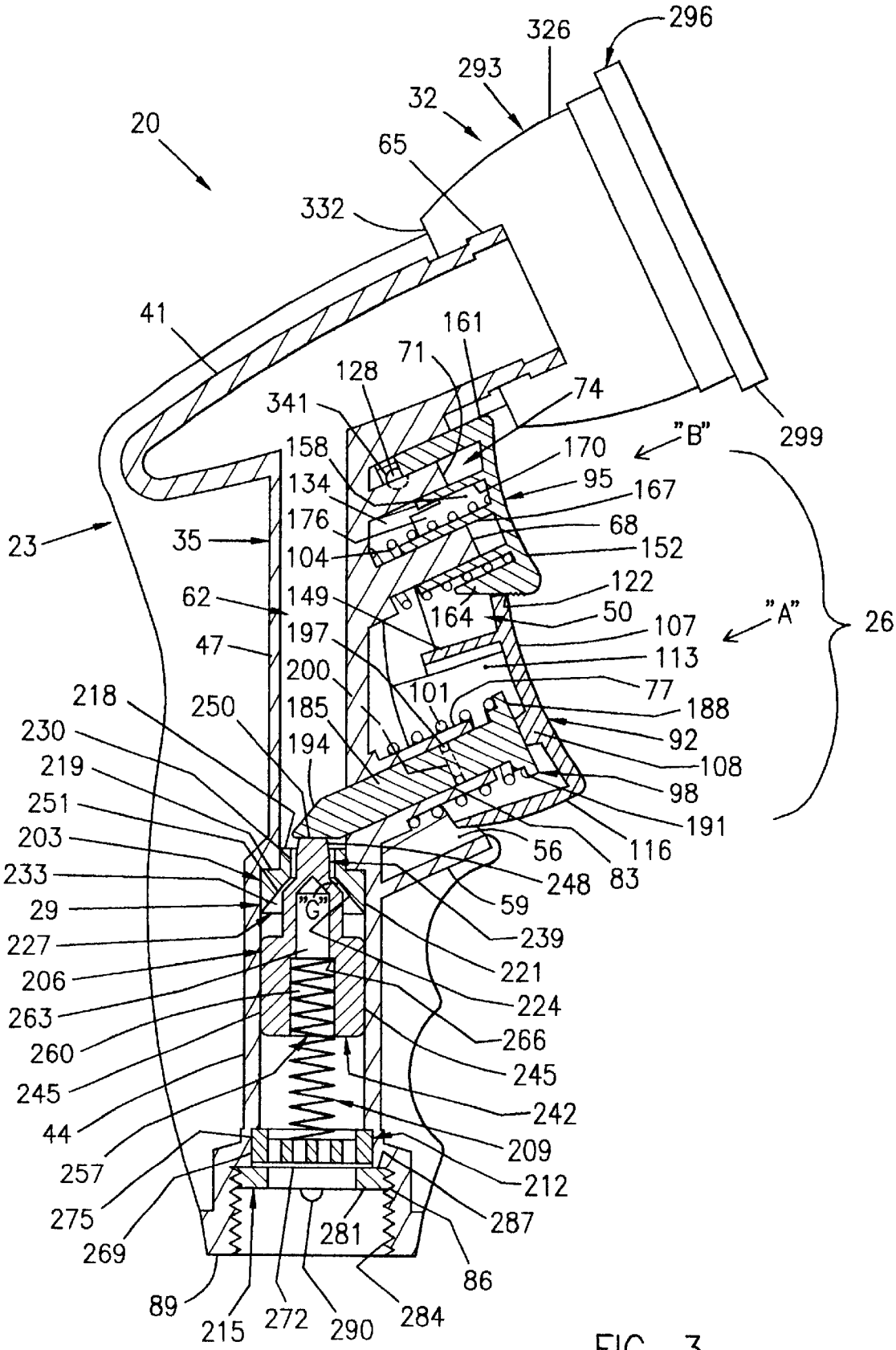
Figure 4:
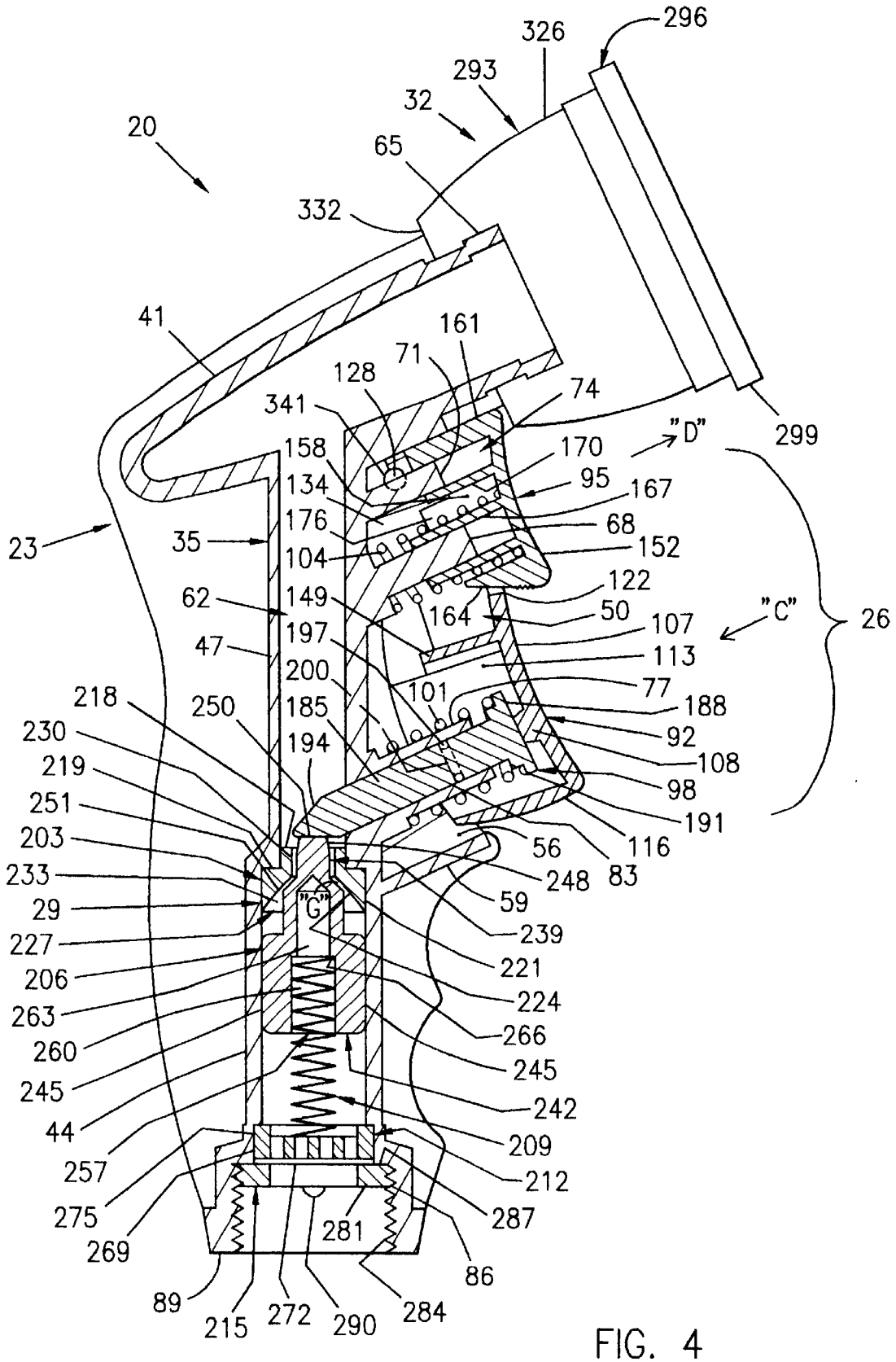

FIG. 3 is a partial vertical sectional view corresponding to FIG. 2 showing the trigger lock being actuated which causes the trigger to be actuated thereby and lock in a partially or fully actuated position such that the desired volume of water flows; and FIG. 4 is a partial vertical sectional view corresponding to FIG. 2 showing the trigger lock being released by actuating only the trigger such that the flow of water stops.

DETAILED DESCRIPTION OF THE ILLUSTRATED EMBODIMENTS

Figure 1:
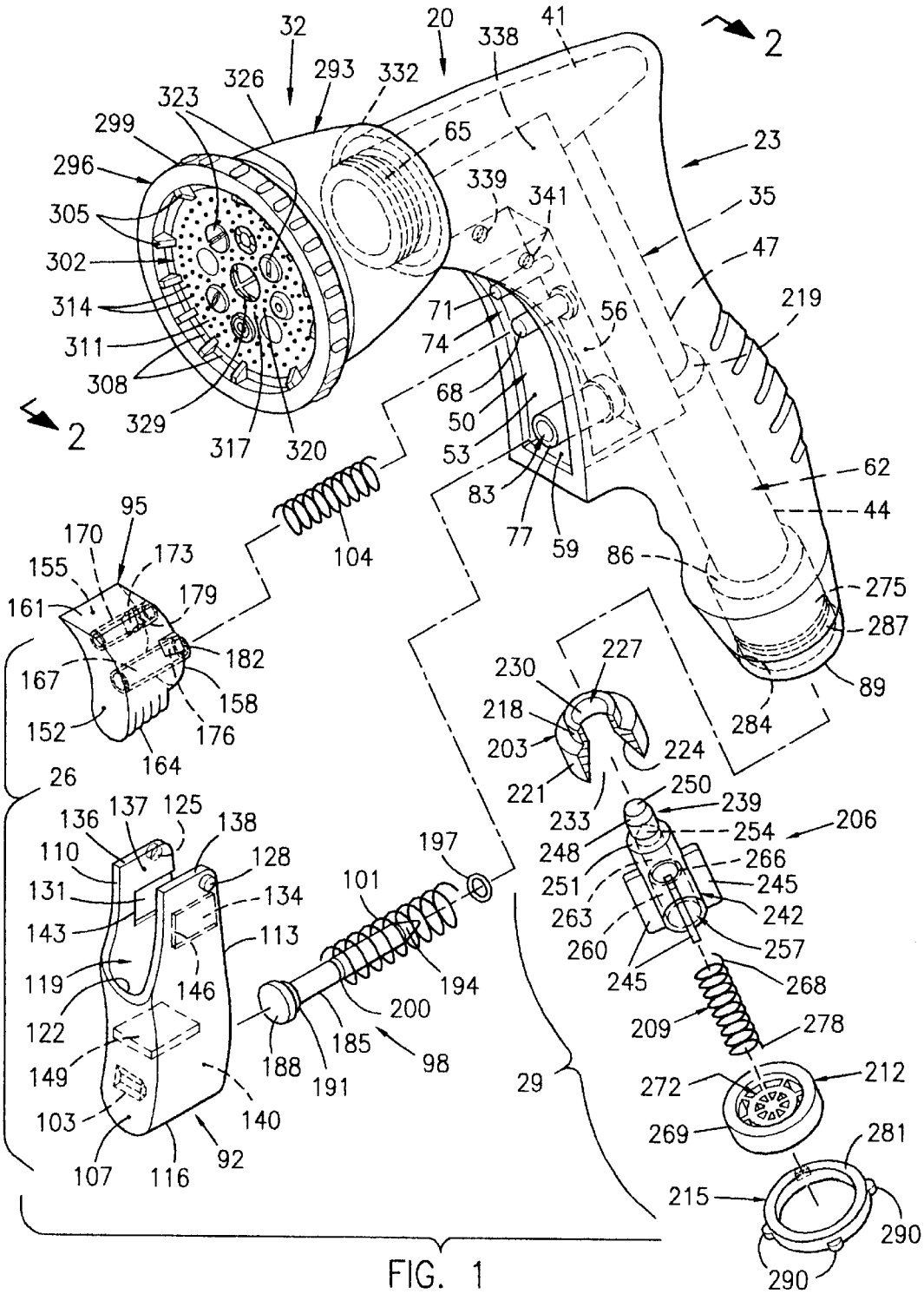
FIG. 1 is an exploded perspective view of the pistol grip garden water spray gun with incrementally controllable locking trigger of the invention.

Referring to FIGS. 1 and 2, therein is shown the pistol grip garden water spray gun with incrementally controllable locking trigger of the invention, garden spray gun 20 which comprises a housing means comprising a contoured housing 23, a trigger means comprising a trigger mechanism 26, a valve means comprising a valve mechanism 29 and a nozzle means comprising a removable nozzle 32.

Contoured housing 23 includes a metal inner housing 35 and a molded rubber or soft plastic outer housing 38 which is molded around metal inner housing 35 to provide a smooth, contoured appearance to housing 23 and a comfortable feel in hand. Inner housing 35 includes an upper nozzle attachment portion 41, a lower garden hose attachment portion 44, and an intermediate trigger receiving portion 47 having a trigger receiving cavity 50 defined by respective side walls 53 and 56, a lower wall 59, and upper nozzle attachment portion 41. A water passageway 62 extends through lower garden hose attachment portion 44, intermediate trigger receiving portion 47, and upper nozzle attachment portion 41 for directing water through metal inner housing 35. Upper nozzle attachment portion 41 includes an externally threaded end 65 which threadably attaches to nozzle 32. Intermediate trigger receiving portion 47 includes a trigger lock guide means comprising respective solid large and small posts 68 and 71 which extend therefrom into an upper portion 74 of trigger receiving cavity 50. Intermediate trigger receiving portion 47 further includes a tubular post 77 which extends from intermediate trigger receiving portion 47 into a lower portion 80 of trigger receiving cavity 50, which tubular post 77 includes an internal passageway 83 which connects with water passageway 62. Lower garden hose attachment portion 44 includes an annular step 86 and an internally threaded female end portion 89 for attachment to a standard externally threaded male end of a standard garden hose (not shown).

Trigger mechanism 26 comprises a trigger 92, a trigger lock 95, a slide pin 98, and a pair of spring means comprising respective compression springs 101 and 104, with an engagement means of trigger 92 and trigger lock 95 interacting therebetween. Trigger 92 includes a slightly concave front wall 107 having an internal bulge 108, a pair of dependent side walls 110 and 113, and a dependent rounded lower wall 116. Front wall 107 includes a notch 119 having a curved, sharpened lower edge 122 comprising the engagement means of trigger 92. Side walls 110 and 113 include respective studs 125 and 128 which extend outwardly therefrom and respective recesses 131 and 134 which extend forward partially across respective inside faces 137 and 140 of side walls 110 and 113 terminating at respective edges 143 and 146. A lateral wall 149 connects front wall 107 and side walls 110 and 113 with a pin actuation hump 150 between lateral wall 149 and rounded lower wall 116 extending rearwardly from front wall 107.

Trigger lock 95 includes a concave front wall 152, a pair of dependent side walls 155 and 158, a flat upper wall 161, a dependent rounded angled lower wall 164 comprising the engagement means of trigger lock 95, with the trigger lock guide means further comprising a pair of tubular studs 167 and 170 of trigger lock 95 which extend rearwardly from front wall 152. Side walls 155 and 158 include respective lock tabs 173 and 176 cut therein having respective laterally outwardly disposed locking edges 179 and 182.

Slide pin 98 comprises a circular cross-section body 185 of such a diameter as to closely fit within internal passageway 83 of tubular post 77, with a head 188 at one end thereof having an annular stepped spring seat 191 and a pointed portion 194 at the opposite end thereof. An O-ring 197 fits within an annular groove 200 in body 185.

Valve mechanism 29 comprises a resilient annular valve seat 203, a finned slide valve 206, a compression spring 209, a spring retaining means comprising a retaining screen 212, and a sealing means comprising a resilient sealing ring 215. Valve seat 203 includes an annular stepped end portion 218 of such configuration as to mate with an annular shoulder 219 of intermediate trigger receiving portion 47 of inner housing 35, an opposite sealing end portion 221 having an annular tapered seating surface 224, with a hole 227 which extends through both. Hole 227 includes a pilot portion 230 and longitudinally co-extending coaxial tapered portion 233 which is defined by tapered seating surface 224. Valve seat 203 fits within water passageway 62 in intermediate trigger receiving portion 47 of inner housing 35 at valve seat 203.

Slide valve 206 comprises an upper sealing portion 239, a lower body portion 242, and a plurality of fins 245. Upper sealing portion 239 includes a pilot portion 248 having a generally flat end surface 250 which fits into pilot portion 230 of hole 227 and an annular tapered seat portion 251 having a seat surface 254. Fins 245 extend from lower body portion 242 to closely slidably fit within water passageway 62 in lower garden hose attachment portion 44 and intermediate trigger receiving portion 47 of inner housing 35. A spring-receiving bore 257 coaxially extends completely through lower body portion 242 partially into upper sealing portion 239, and includes a lower spring receiving portion 260 of such an inner diameter as to receive spring 209, and a smaller inner diameter portion 263 of such an inner diameter to form a shoulder 266 therebetween against which a first end 266 of spring 209 abuts.

Retaining screen 212 comprises an annular edge portion 269 and an integral recessed screen portion 272 which pressfits within a larger diameter portion 275 of water passageway 62 in lower garden hose attachment portion 44 of inner housing 35. A second end 278 of spring 209 bears against screen portion 272 of retaining screen 212 so as to retain slide valve 206 and spring 209 in position with seat surface 254 of tapered seat portion 251 of slide valve 206 firmly seated against seating surface 224 of end portion 221 of valve seat 203 so as to prevent the flow of water through water passageway 62 of inner housing 35.

Sealing ring 215 comprises an annular resilient body 281 of such an external diameter as to fit within a larger diameter internally threaded portion 284 of water passageway 62 in lower garden hose attachment portion 44 of inner housing 35 so as to form a shoulder 287 therein, and a plurality of integral resilient locking tabs 290 which bear against threaded portion 284 to retain sealing ring 215 therewithin against shoulder 287. Sealing ring 255 fluidly seals the male hose end fitting (not shown) of a standard type garden hose (not shown) to housing 23 of garden spray gun 20.

Removable nozzle 32 is one of any number of nozzle types which can be used, comprising generally a tapered outer shell 293, a rotary selector 296, and an internal valve mechanism (not shown). Rotary selector 296 includes an annular outer gripping portion 299 and a generally flat inner spray portion 302, interconnected by means of a plurality of ribs 305, so as to define an annular plurality of outer spray openings 308. Inner spray portion 302 includes an annular outer spray portion 311 having a plurality of small holes 314 therethrough, an annular inner spray portion 317 having a plurality of small holes 320 therethrough, and a plurality of annularly disposed specialty nozzles 323 therebetween for spraying various water spray patterns. Rotary selector 296 is rotatably connected to removable nozzle 32 at an outlet end 326 of outer shell 293 by means of a screw 329 which threads into the internal valve mechanism of removable nozzle 32. Removable nozzle 32 screwably connects to an externally threaded end portion 332 of upper nozzle attachment portion 41 of inner housing 35 at an inlet end of outer shell 293 by means of an internally threaded portion (not shown) of the internal valve mechanism of removable nozzle 32 with an annular shoulder 335 of outer shell 293 which is clamped therebetween. Rotation of rotary selector 296 allows selection of water spray from outer spray openings 308, holes 314 of outer spray portion 311, the individual specialty nozzles 323, or holes 320 of inner spray portion 317, and certain combinations thereof.

Referring to FIG. 3, therein is shown the initiation of water spray and the locking of such water spray at the desired flow rate from spray gun 20. The flow of water is initiated without engaging the locking function by applying force so as to depress trigger 92 into housing 23 as shown by arrow "A". When trigger 92 is so depressed, sharpened lower edge 122 of notch 119 of trigger 92 pivots downwardly and rearwardly away from ribs 305 of angled lower wall 164 of trigger lock 95 such that trigger 92 is free to move in both directions to control the flow of water without locking. By depressing trigger 92, trigger 92 inwardly pivots about studs 125 and 128 engaged in respective detentes 339 and 341 of side walls 53 and 56 of inner housing 35 against the bias of spring 101 with the outward movement of trigger 92 being stopped by contact of respective upper edges 336 and 337 of side walls 110 and 113 with upper surface 338 of inner housing 35, with bulge 108 of concave front wall 107 of trigger 92 which bears against head 188 of slide pin 98 pushing body 185 of slide pin 98 rearwardly along internal passageway 83 of tubular post 77 such that pointed portion 194 thereof contacts end surface 250 of slide valve 206 moving the same downwardly against the bias of spring 209 such that annular tapered seat portion 251 of slide valve 206 moves away from annular tapered seating surface 224 of valve seat 203 creating a gap "G" allowing water to flow through water passageway 62 of inner housing 35. The further trigger 92 is depressed, the larger gap "G" and the greater the flow of water therethrough and out of nozzle 32. When the force on trigger 92 is released altogether, spring 101 causes slide pin 98 and trigger 92 to return to the unactuated position allowing spring 209 to return slide valve 206 to close gap "G" so as to stop the flow of water.

Again referring to FIG. 3, the flow of water is initiated while simultaneously engaging the locking function by depressing trigger lock 95 into housing 23 as shown by arrow "B". As such, trigger lock 95 inwardly linearly moves with large and small tubular studs 167 and 170 linearly sliding about the respective large and small posts 68 and 71 of inner housing 35 against the bias of spring 104. Simultaneously when trigger lock 95 is so depressed, successive ribs 305 of angled lower wall 164 of trigger lock 95 engage sharpened lower edge 122 of notch 119 of trigger 92, pivoting trigger 92 inwardly about studs 125 and 128 engaged in respective detentes 339 and 341 of side walls 53 and 56 of inner housing 35 against the bias of spring 101, with bulge 108 of concave front wall 107 of trigger 92 which bears against head 188 of slide pin 98 which actuates valve mechanism 29 to initiate the flow of water as described above. When the desired flow of water is achieved by depressing trigger 92 to set gap "G", the user releases the force to depress trigger lock 95 such that ribs 305 of angled lower wall 164 of trigger lock 95 restrict trigger 92 from pivoting outwardly such that trigger 92, slide pin 98, and slide valve 206 are maintained in position with the desired gap "G" such that flow rate of water is maintained without maintaining force to hold trigger 92 or trigger lock 95 in such depressed position.

Referring to FIG. 4, the flow of water is stopped while using the locking function by depressing trigger 92 into housing 23 as shown by arrow "C". When trigger 92 is so depressed, sharpened lower edge 122 of notch 119 of trigger 92 pivots downwardly and rearwardly away from ribs 305 of angled lower wall 164 of trigger lock 95 such that trigger lock 95 linearly outwardly moves as shown by arrow "D" under the bias of spring 104 to the unactuated position shown. Therefore, when the force depressing trigger 92 is released, trigger 92 pivots outwardly under the bias of spring 101 to the unactuated position, shutting off the flow of water as described above. However, after depressing trigger 92 to release trigger lock 95, trigger 92 can be used to freely regulate the flow of water without completely releasing trigger 92. Likewise, light force can be maintained on trigger lock 95 while trigger 92 is depressed, trigger lock 95 positioned at the approximate position for the desired water flow to be maintained, and the force on trigger 92 released followed by that on trigger lock 95 such that trigger 92 is locked in position at the desired flow rate of water from nozzle 32.

Many variations of the water spray gun and with incrementally controllable locking trigger of the invention are possible while staying within the same inventive concept. For example, the normally closed valve assembly can be of any suitable type such as a self-contained valve, or wherein the actuator member is part of the valve assembly such as by including a seal thereon to selectively close and open a hole in the housing which connects two halves of the water passageway. Other arrangements of the trigger mechanism are possible wherein the trigger and trigger lock still function such that the trigger alone can be used to freely depressed and released to control the flow of water, and wherein the trigger lock alone can be depressed to depress and lock the trigger in the desired position and the trigger can be subsequently depressed to release the locking function. Examples include the trigger lock being pivotally connected to the housing and the trigger linearly connected, both being pivotally connected, or both being linearly connected thereto. The pivot location of the trigger can be moved forward or backward as well. The nozzle can be fixedly connected to the housing or removable therefrom, the housing can be other than of the pistol-grip sprayer type such as an elongate, generally straight housing to which an extension wand type nozzle can be fixedly or removably connected. The water spray gun can be adapted for use to spray liquids other than water and the trigger mechanism can be used on other types of spray devices. The actuator member can be integral with the trigger, pivotally attached thereto, or a separate piece as shown.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A water spray device for use with a standard garden hose having a flexible body with respective male and female threaded connectors affixed to opposite ends thereof, and to which a spray nozzle is connectable, comprising:

a housing having a lower gripping portion, a middle trigger portion having a trigger chamber, and an upper nozzle attachment portion, said gripping portion having a female threaded end connectable to the male connector of the garden hose, said upper nozzle attachment portion having a nozzle attachment end connectable to the spray nozzle, a water passageway which extends completely through said housing from said female threaded end to said nozzle attachment end, and an actuator member receiving hole which connects said chamber to said water passageway;

a closed-biased valve assembly disposed in said water passageway to allow selective regulation of the flow of water therethrough;

a trigger mechanism comprising a trigger, a trigger lock, a pair of first and second springs, and an actuator member, said trigger being movably connected to said housing at least partially disposed within said chamber and which includes a notch through an upper portion of said trigger, said trigger lock being movably connected to said housing within said notch of said trigger at least partially disposed within said chamber being outwardly biased by said first spring, one of said trigger and said trigger lock being pivotally movably connected to said housing and the other thereof being linearly movably connected to said housing, said actuator member being slidably disposed in said actuator member hole and biased outwardly from said housing against said trigger by said second spring, said trigger and trigger lock being retained at least partially disposed within said chamber by means of contact of at least one thereof with a portion of said housing; and wherein said valve assembly is actuatable so as to allow water to flow through said water passageway by means of applying force to depress said trigger toward said housing such that a first end of said actuator member contacts said closed-biased valve assembly to open said valve assembly to allow the desired flow of water therethrough in said water passageway, and wherein a lower portion of said notch and a lower portion of said trigger lock are interactable such that when force is applied to and said trigger lock is depressed toward said housing, said lower portion of said trigger lock contacts said lower portion of said notch so as to depress said trigger toward said chamber to actuate said valve assembly to allow the flow of water, and when the force applied to said trigger lock is released, said trigger and said trigger lock are retained in such position until force is applied to said trigger to move said lower portion of said notch out of contact with said lower portion of said trigger lock such that said first spring biases said trigger lock outwardly.

2. A water spray device according to claim 1, wherein the lower portions of the trigger lock and the notch of the trigger interengage by means of one thereof having a laterally ribbed surface and the other thereof having at least one projection of mating configuration therewith.

3. A water spray device according to claim 2, wherein the ribbed surface is angled upwardly relative to tangent to the movement thereof.

4. A water spray device according to claim 2, wherein the laterally ribbed surface is on the trigger lock and the lower portion of the notch of the trigger has an edge of mating configuration thereto.

5. A water spray device according to claim 4, wherein the laterally ribbed surface comprises a plurality of generally parallel ribs of generally triangular cross-section and the lower portion of the notch of the trigger has a generally sharpened edge.

6. A water spray device according to claim 4, wherein the lower portion of the trigger lock with the laterally ribbed surface is of convex curvature and the lower portion of the notch of the trigger is of mating concave curved configuration respective to said ribbed surface.

7. A water spray device according to claim 1, wherein the valve assembly comprises a resilient valve seat, a slide valve, and a third spring, wherein said valve seat closely fits within and is secured within said water passageway and includes a hole therethrough and a seat surface, said slide valve which includes a seat surface corresponding to said seat surface of said valve seat, said third spring being arranged with said housing so as to bias said slide valve toward said valve seat to provide a water tight seal in said water passageway.

8. A water spray device according to claim 7, wherein the valve assembly further includes a retaining screen which is affixed within the water passageway between the female threaded end of the housing and the valve assembly to retain the third spring in position biased against the slide valve while permitting water flow therepast.

9. A water spray device according to claim 1, wherein the valve assembly further includes a seal for fluidly sealing between the actuator member and the actuator member receiving hole of the housing to prevent fluid flow between the water passageway and the chamber of said housing.

10. A water spray device according to claim 9, wherein the actuator member hole is of generally circular cross-section having an inner surface and the actuator member comprises a circular cross-section slide pin having a headed second end with the first end being of a generally conically pointed configuration, with an annular groove therebetween and the seal comprises an O-ring disposed in said annular groove for fluidly sealing between said inner surface of said actuator member hole and said slide pin to prevent fluid flow between the water passageway and the chamber of the housing.

11. A water spray device according to claim 1, wherein the trigger is partially disposed within the chamber being pivotally movably connected to the housing at an upper portion of said chamber, and the trigger lock is partially disposed within said upper portion of said chamber being linearly slidably movably connected to said housing.

12. A water spray device according to claim 11, wherein the lower portions of the trigger lock and the notch of the trigger interengage by means of one having a laterally ribbed surface and the other having at least one projection of mating configuration therewith.

13. A water spray device according to claim 12, wherein the ribbed surface is angled upwardly relative to tangent to the movement thereof.

14. A water spray device according to claim 12, wherein the laterally ribbed surface is on the trigger lock and the lower portion of the notch of the trigger has an edge of mating configuration thereto.

15. A water spray device according to claim 14, wherein the laterally ribbed surface comprises a plurality of generally parallel ribs of generally triangular cross-section and the lower portion of the notch of the trigger has a generally sharpened edge.

16. A water spray device according to claim 14, wherein the lower portion of the trigger lock with the laterally ribbed surface is of convex curvature and the lower portion of the notch of the trigger is of mating concave curved configuration respective to said ribbed surface.

17. A water spray device according to claim 11, wherein the valve assembly comprises a resilient valve seat, a slide valve, and a third spring, wherein said valve seat closely fits within and is secured within said water passageway and includes a hole therethrough and a seat surface, said slide valve which includes a seat surface corresponding to said seat surface of said valve seat, said third spring being arranged with said housing so as to bias said slide valve toward said valve seat to provide a water tight seal in said water passageway.

18. A water spray device according to claim 17, wherein the valve assembly further includes a retaining screen which is affixed within the water passageway between the female threaded end of the housing and the valve assembly to retain the third spring in position biased against the slide valve while permitting water flow therepast.

19. A water spray device according to claim 11, wherein the valve assembly further includes a seal for fluidly sealing between the actuator member and the actuator member receiving hole of the housing to prevent fluid flow between the water passageway and the chamber of said housing.

20. A water spray device according to claim 19, wherein the actuator member hole is of generally circular cross-section having an inner surface and the actuator member comprises a circular cross-section slide pin having a headed second end with the first end being of a generally conically pointed configuration, with an annular groove therebetween and the seal comprises an O-ring disposed in said annular groove for fluidly sealing between said inner surface of said actuator member hole and said slide pin to prevent fluid flow between the water passageway and the chamber of the housing.

21. A water spray device according to claim 11, wherein the trigger lock is linearly slidably movably connected to the housing by means of one thereof having a guide member and the other having a mating guide hole with the first spring which biases said trigger lock from said housing.

22. A water spray gun according to claim 21, wherein the trigger is generally hollowed defining an inner rear chamber with a front wall and is pivotally connected to the housing at an upper portion of the trigger chamber, the trigger lock is generally hollow defining an inner rear chamber and includes a tubular guide member which extends rearwardly into said inner rear chamber thereof from a front wall thereof about which the first spring is disposed, the housing includes a trigger lock guide member which closely fits within said tubular guide member to telescope therewith for linear movement of said trigger lock, and said housing further includes a tubular actuator member guide which extends into a lower portion of said trigger chamber coaxial with the actuator member receiving hole into which the actuator member closely fits and about which the second spring is disposed so as to guide the actuator member upon urging by contact with said front wall of said trigger.

23. A water spray gun according to claim 21, wherein the trigger lock includes an upper surface which is generally parallel to the guide member and guide hole, and the housing includes a mating surface at an upper portion of the trigger chamber which is disposed closely adjacent said upper surface of said trigger lock so as to prevent rotation thereof about said guide member and guide hole.

24. A water spray gun according to claim 21, wherein there are a pair of guide members and mating guide holes by which the trigger lock is linearly slidably movably connected to the housing so as to prevent rotation of the trigger lock.

25. A water spray gun according to claim 24, wherein the trigger is generally hollowed defining an inner rear chamber with a front wall and is pivotally connected to the housing at an upper portion of the trigger chamber, the trigger lock is generally hollow defining an inner rear chamber and includes a tubular guide member which extends rearwardly into said inner rear chamber thereof from a front wall thereof about which the first spring is disposed, the housing includes a trigger lock guide member which closely fits within said tubular guide member to telescope therewith for linear movement of said trigger lock, and said housing further includes a tubular actuator member guide which extends into a lower portion of said trigger chamber coaxial with the actuator member receiving hole into which the actuator member closely fits and about which the second spring is disposed so as to guide the actuator member upon urging by contact with said front wall of said trigger.

26. A water spray gun according to claim 24, wherein the trigger lock includes an upper surface which is generally parallel to the guide member and guide hole, and the housing includes a mating surface at an upper portion of the trigger chamber which is disposed closely adjacent said upper surface of said trigger lock so as to prevent rotation thereof about said guide member and guide hole.

27. A trigger mechanism for a water spray gun of the type for use with a standard garden hose having a flexible body with respective male and female threaded connectors affixed to opposite ends thereof, and to which a spray nozzle is connectable, the water spray gun having a housing with a lower gripping portion, a middle trigger portion having a trigger chamber, and an upper nozzle attachment portion, the gripping portion having a female threaded end connectable to the male connector of the garden hose, the upper nozzle attachment portion having a nozzle attachment end connectable to the spray nozzle, a water passageway which extends completely through the housing from the female threaded end to the nozzle attachment end, an actuator member receiving hole which connects the chamber to the water passageway, and a closed-biased valve assembly disposed in the water passageway to allow selective regulation of the flow of water therethrough, the trigger mechanism comprising:

a trigger movably connected to the housing at least partially disposed within the trigger chamber, said trigger having a notch through an upper portion thereof;

a trigger lock movably connected to the housing within said notch of said trigger at least partially disposed within the chamber;

a first spring disposed within the chamber which outwardly biases said trigger lock from the housing;

an actuator member slidably disposed in the actuator member hole;

a second spring disposed about said actuator member which outwardly biases said actuator member from the housing; and an actuator member slidably disposed in the actuator member hole outwardly biased from the housing by said second spring; and wherein one of said trigger and said trigger lock is pivotally movably connected to the housing and the other thereof is linearly movably connected to said housing, said trigger and trigger lock being retained at least partially disposed within the chamber by means of contact of at least one thereof with a portion of the housing such that the valve assembly is actuatable so as to allow water to flow through the water passageway by means of applying force to depress said trigger toward the housing such that a first end of said actuator member contacts the valve assembly to open the valve assembly to allow the desired flow of water therethrough in the water passageway, and wherein a lower portion of said notch and a lower portion of said trigger lock are interactable such that when force is applied to and said trigger lock is depressed toward the housing, said lower portion of said trigger lock contacts said lower portion of said notch so as to depress said trigger toward the chamber to actuate the valve assembly to allow the flow of water, and when the force applied to said trigger lock is released, said trigger and said trigger lock are retained in such position until force is applied to said trigger to move said lower portion of said notch out of contact with said lower portion of said trigger lock such that said first spring biases said trigger lock outwardly.

28. A trigger mechanism according to claim 27, wherein the lower portions of the trigger lock and the notch of the trigger interengage by means of one thereof having a laterally ribbed surface and the other thereof having at least one projection of mating configuration therewith.

29. A trigger mechanism according to claim 28, wherein the ribbed surface is angled upwardly relative to tangent to the movement thereof.

30. A trigger mechanism according to claim 28, wherein the laterally ribbed surface is on the trigger lock and the lower portion of the notch of the trigger has an edge of mating configuration thereto.

31. A trigger mechanism according to claim 27, wherein the trigger is partially disposed within the chamber being pivotally movably connected to the housing at an upper portion of the chamber, and the trigger lock is partially disposed within the upper portion of the chamber being linearly slidably movably connected to the housing.

32. A trigger mechanism according to claim 31, wherein the lower portions of the trigger lock and the notch of the trigger interengage by means of one thereof having a laterally ribbed surface and the other thereof having at least one projection of mating configuration therewith.

33. A trigger mechanism according to claim 32, wherein the ribbed surface is angled upwardly relative to tangent to the movement thereof.

34. A trigger mechanism according to claim 32, wherein the laterally ribbed surface is on the trigger lock and the lower portion of the notch of the trigger has an edge of mating configuration thereto.

35. A trigger mechanism according to claim 31, wherein the trigger lock is linearly slidably movably connected to the housing by means of one thereof having a guide member and the other having a mating guide hole with the first spring which biases said trigger lock from the housing.

36. A trigger mechanism according to claim 35, wherein the trigger is generally hollowed defining an inner rear chamber with a front wall and is pivotally connected to the housing at an upper portion of the trigger chamber, the trigger lock is generally hollow defining an inner rear chamber and includes a tubular guide member which extends rearwardly into said inner rear chamber thereof from a front wall thereof about which the first spring is disposed, the housing being of the type which includes a trigger lock guide member which closely fits within said tubular guide member to telescope therewith for linear movement of said trigger lock, the housing further being of the type which includes a tubular actuator member guide which extends into a lower portion of the trigger chamber coaxial with the actuator member receiving hole into which the actuator member closely fits and about which the second spring is disposed so as to guide the actuator member upon urging by contact with said front wall of said trigger.

37. A trigger mechanism according to claim 35, wherein the trigger lock includes an upper surface which is generally parallel to the guide member and guide hole, and the housing being of the type which includes a mating surface at an upper portion of the trigger chamber which is disposed closely adjacent said upper surface of said trigger lock so as to prevent rotation thereof about said guide member and guide hole.

38. A trigger mechanism according to claim 35, wherein there are a pair of guide members and mating guide holes by which the trigger lock is linearly slidably movably connected to the housing so as to prevent rotation of the trigger lock.

39. A trigger mechanism according to claim 38, wherein the trigger is generally hollowed defining an inner rear chamber with a front wall and is pivotally connected to the housing at an upper portion of the trigger chamber, the trigger lock is generally hollow defining an inner rear chamber and includes a tubular guide member which extends rearwardly into said inner rear chamber thereof from a front wall thereof about which the first spring is disposed, the housing being of the type which includes a trigger lock guide member which closely fits within said tubular guide member to telescope therewith for linear movement of said trigger lock, and the housing further being of the type which includes a tubular actuator member guide which extends into a lower portion of the trigger chamber coaxial with the actuator member receiving hole into which the actuator member closely fits and about which the second spring is disposed so as to guide the actuator member upon urging by contact with said front wall of said trigger.

40. A trigger mechanism according to claim 38, wherein the trigger lock includes an upper surface which is generally parallel to the guide member and guide hole, and the housing being of the type which includes a mating surface at an upper portion of the trigger chamber which is disposed closely adjacent said upper surface of said trigger lock so as to prevent rotation thereof about said guide member and guide hole.

* * * * *